US005389032A

United States Patent [19]

Beardsley

[11] Patent Number: 5,389,032

[45] Date of Patent: Feb. 14, 1995

[54] ABRASIVE ARTICLE

[75] Inventor: Kris A. Beardsley, Stillwater, Minn.

[73] Assignee: Minnesota Mining and Manufacturing Company, St. Paul, Minn.

[21] Appl. No.: 277,242

[22] Filed: Jul. 19, 1994

Related U.S. Application Data

[63] Continuation of Ser. No. 44,181, Apr. 7, 1993, abandoned.

[51] Int. Cl.[6] ..... B24B 23/00; B24D 13/14; B24D 11/04

[52] U.S. Cl. ..... 451/359; 451/461; 451/529; 451/486; 451/523

[58] Field of Search ..... 51/170 R, 170 T, 177, 51/181 R, 395, 397–398, 405, 326, 391–392, 384, 209 R, 375, 372, 354; 451/344, 359, 353, 461, 527, 529, 530, 537, 57, 523, 524, 516, 548, 507, 504, 486

[56] References Cited

U.S. PATENT DOCUMENTS

| | | | |
|---|---|---|---|
| 449,930 | 7/1891 | Dubey . | |
| 1,953,983 | 4/1934 | Benner | 51/280 |
| 2,028,874 | 1/1936 | Kramer et al. | 51/195 |
| 2,217,791 | 10/1940 | Burleigh | 51/197 |
| 2,309,016 | 1/1943 | Ryan | 51/209 R |
| 2,930,056 | 3/1960 | Lappin | 51/177 |
| 3,014,319 | 12/1961 | Olton | 51/195 |
| 3,082,582 | 3/1963 | Jeske | 51/195 |
| 3,171,820 | 3/1965 | Volz | 260/2.5 |
| 3,346,904 | 10/1967 | Armstrong | 15/230.12 |
| 3,418,675 | 12/1968 | Meguiar et al. | 15/230 |
| 3,537,121 | 11/1970 | McAvoy | 15/230.12 |
| 3,924,362 | 12/1975 | McAleer | 51/358 |
| 4,343,112 | 8/1982 | Jarrett | 51/131 |
| 4,511,604 | 4/1985 | McCartney | 427/246 |
| 4,523,411 | 6/1985 | Freerks | 51/209 R |
| 4,609,581 | 9/1986 | Ott | 428/100 |
| 4,728,552 | 3/1988 | Jensen, Jr. | 428/91 |
| 4,683,683 | 8/1987 | Block | 51/377 |
| 4,841,680 | 6/1989 | Hoffstein et al. | 51/283 |
| 4,951,423 | 8/1990 | Johnson | 51/168 |
| 5,141,555 | 8/1992 | Elepano | 106/10 |
| 5,167,096 | 12/1992 | Eltoukhy et al. | 51/281 |
| 5,297,364 | 3/1992 | Tuttle | 51/209 R |
| 5,297,366 | 3/1994 | Huddleston | 51/376 |

FOREIGN PATENT DOCUMENTS

| | | | |
|---|---|---|---|
| 0196832 | 10/1986 | European Pat. Off. | B24D 13/14 |
| 0344610 | 12/1989 | European Pat. Off. | B24D 7/14 |
| 1254735 | 1/1961 | France . | |
| 2120867 | 11/1972 | Germany | B24D 13/14 |
| 3043044 | 6/1982 | Germany . | |
| 56-126581 | 10/1981 | Japan | B24D 11/00 |
| 58-4361 | 1/1983 | Japan | B24D 11/00 |
| 58-149176 | 5/1983 | Japan | B24D 7/14 |
| 0247293 | 2/1947 | Switzerland | 51/209 R |
| 990142 | 4/1965 | United Kingdom | A47I 11/00 |
| 0311735 | 10/1971 | U.S.S.R. | 51/209 R |
| 1440679 | 11/1988 | U.S.S.R. | 51/401 |

*Primary Examiner*—Robert A. Rose
*Attorney, Agent, or Firm*—Gary L. Griswold; Walter N. Kirn; James J. Trussell

[57] ABSTRACT

The present invention relates to an abrasive article for abrading material from a workpiece. In one embodiment, the abrasive article includes a back-up pad having first and second major surfaces. The first major surface includes a shaft adapted to connect the abrasive article to an abrading apparatus for movement relative thereto. Adjoining the second major surface are first and second resilient support portions, to which are attached first and second abrading members, respectively. When an operator applies a first force to the abrading apparatus, the first abrasive surface contacts and abrades the workpiece. When the operator applies a second force that is greater than the first force, both the first and the second abrasive surfaces contact and abrade the workpiece.

18 Claims, 2 Drawing Sheets

ABRASIVE ARTICLE

This is a continuation of application Ser. No. 08/044,181, filed Apr. 7, 1993, now abandoned.

TECHNICAL FIELD

This invention relates to an abrasive article for removing material from a workpiece.

BACKGROUND OF THE INVENTION

Abrasives are commonly used in a wide variety of fields for abrading material from a workpiece. The workpiece may be made of a material such as wood, plastic, metal, or glass, and typically may have an excess of such material or an undesirable surface finish, or both. In either case, or for other similar applications, an abrasive article is typically used to abrade the surface of the workpiece until the excess material has been removed or the surface finish has been refined, or both. Two popular types of abrasives are nonwoven abrasives and coated abrasives, and either may be provided with a range of surface characteristics to abrade a workpiece in a desired manner.

For a typical abrading process, a variety of abrasive articles may be used to provide a progressively finer finish. These abrasive articles are typically used in series, wherein the abrasive articles used initially remove deep scratches and excess material, and later abrasive members refine and finish the surface as desired. For example, a cast or molded part may have an excess of material in one or more locations as well as a relatively rough surface finish. A worker may first use a coarse abrasive to remove most of the excess material and to abrade away any deep scratches in the surface finish. The worker may then change tools, and use a finer grade abrasive to remove more of the excess material and to refine the surface further. Finally the worker may use a still finer grade abrasive member to remove minor imperfections and scratches from the surface of the workpiece. This method is known as the "grade sequence" method of abrading, and is widely used for a variety of applications.

Abrading, as that term is used herein, includes not only sanding, grinding, and macroscopic surface refinishing, but also buffing, polishing, and other types of microscopic surface finishing and refinement as well. Buffing, as that term is used herein, is the process used to remove small scratches left by the fine grade abrasive used in the final sanding step. Polishing, as that term is used herein, is the process used to remove any swirl marks left by the buffing member. Both buffing and polishing typically require the addition of certain compounds to enhance and refine the surface finish. Hence a worker may use one or more abrasive articles sequentially to grind away excess material in the manner described above, and may use one or more buffing and polishing members sequentially to produce the appropriate surface finish on the workpiece.

Although sequential abrading processes like those described above are generally effective in producing a workpiece of a desired size and finish, these processes may require many different tools. If, for instance, a worker uses two sanding or grinding steps, a buffing step and a polishing step, a total of four different tools may be required. The worker must then exchange and manipulate these four tools during the process of abrading a single workpiece. In the course of a single working shift, each tool may be picked up and set down dozens or even hundreds of times, which results in a substantial amount of time used to manipulate the different tools.

It is therefore desirable to provide an abrading article that includes more than one abrasive surface, to enable a worker to complete more than one abrading step with each tool.

SUMMARY OF THE INVENTION

An abrasive article is provided for abrading material from a workpiece. The article includes a back-up pad having at least one abrading surface, wherein a first portion of the at least one abrading surface contacts the workpiece in response to a first force applied to the abrasive article, and first and second portions of the at least one abrading surface contact the workpiece in response to a second force applied to the abrasive article. The second force is greater than the first force. In one embodiment, the first portion comprises a first planar abrading surface, and the second portion comprises a second planar abrading surface.

Also provided is an abrasive article for abrading material from a workpiece, including a back-up pad having a central substantially planar abrading surface having means for abrading the workpiece, and at least one peripheral substantially planar abrading surface having means for abrading the workpiece. One of the planar abrading surfaces contacts the workpiece in response to a first force applied to the abrasive article in the direction of the workpiece, and both of the planar abrading surfaces contact the workpiece in response to a second force applied to the abrasive article in the direction of the workpiece. Again, the second force is greater than the first force.

The present invention also includes within its scope a method of abrading material from a workpiece. The method includes the steps of providing an abrading apparatus having a body adapted to be held by an operator and a resilient back-up pad attached to the body, the back-up pad including first and second abrasive surfaces adapted for abrading the workpiece; urging the abrading apparatus against the workpiece using a first force to enable the first abrasive surface to contact and move relative to the workpiece to abrade material therefrom; and urging the abrading apparatus against the workpiece using a second force that is greater than the first force, to enable the first and second abrasive surfaces to contact and move relative to the workpiece to abrade material therefrom. In one embodiment, the first and second abrasive surfaces used in the method are each adapted to produce a different surface finish on the workpiece. In another embodiment, the back-up pad for use with the method is adapted for movement relative to the body, and the body comprises motive means for inducing relative movement between the body and the back-up pad.

BRIEF DESCRIPTION OF THE DRAWINGS

The invention will be more readily understood with reference to the accompanying drawings, wherein like reference numerals refer to like components throughout the several views, and wherein.

DETAILED DESCRIPTION

Figure 1:
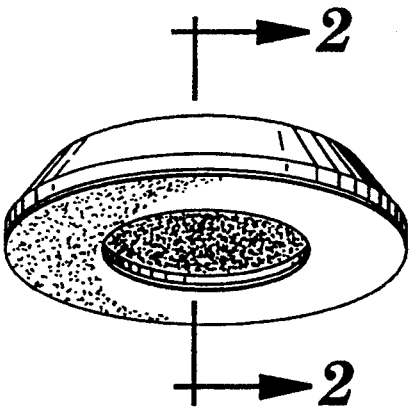
FIG. 1 is a perspective view of an abrasive article according to the present invention.

The abrasive article of the present invention is generally designated by reference numeral 10. In general terms, abrasive article 10 includes first and second abrading surfaces. When a first force (hereinafter "F1") is applied to the back-up pad, the first abrading surface is in contact with the workpiece. When a second force (hereinafter "F2") that is greater than the first force is applied to the back-up pad, both the first and second abrading surfaces are in contact with the workpiece. If the first and second abrasive surfaces are provided with abrasives that produce different surface finishes, two abrading steps (e.g. coarse abrading and fine abrading, or buffing and polishing) may be completed with a single tool. Furthermore, the abrasive article of the invention has broad applicability to both power driven tools (e.g. pneumatic and electric) and hand held tools (e.g. a sanding block).

It should be noted that the terms "first force" and "second force" are used to designate relative amounts of force, rather than the order in which those forces are applied. Thus, the greater force (the second force, as described herein) could be applied first, and the lesser force (the first force, as described herein) could be applied second. The application of greater and lesser forces is thus contemplated, without regard to the particular order in which those forces are applied.

Abrasive article 10 may be moved relative to a workpiece 26 by any known means, indicated schematically as abrading apparatus 18. For example, a hand-held sanding block, a rotary sander, an orbital sander, a random orbital sander, a dual action sander, and a straight line sander all have utility in conjunction with abrasive article 10. In the embodiment illustrated in FIGS. 1 through 3, abrasive article 10 is shown in a configuration that may be suitable for use with a rotary sander. Abrasive article 10 includes a back-up pad 12 having first and second major surfaces 14 and 16, respectively. First major surface 14 includes means for connecting back-up pad 12 to an abrading apparatus 18. Connection means may comprise a shaft 17 that is connected to and projects orthogonally from first major surface 14, allowing back-up pad 12 to move relative to apparatus 18.

Second surface 16 is generally planar and includes first and second support portions 20 and 22, respectively, which are adapted to carry first and second abrasive surfaces 24 and 28, respectively. First support portion 20 and first abrasive surface 24 have a combined thickness $t_f$; and second support portion 22 and second abrasive surface 28 have a combined thickness $t_s$ that is less than $t_f$; when the back-up pad is subjected to first force F1, as shown in FIG. 2A. First support portion 20 is more compressible than second support portion 22, and thus when first force F1 is applied, only first abrasive surface 24 contacts workpiece 26. When second force F2, which is greater than first force F1, is applied, both first abrasive surface 24 and second abrasive surface 28 contact workpiece 26.

It should be understood that although the present invention is illustrated in terms of discrete first and second support portions 20 and 22, these support portions could instead be integrally formed with back-up pad 12. Second abrasive surface 28 would still be recessed by a distance ($t_f$-$t_s$) from first abrasive surface 24, and in all other respects would function as described herein. If first and second support surfaces 20 and 22 are discrete, each may be connected to surface 16 of back-up pad 12 by any known means, such as adhesive or cooperative interengaging or intermeshing fastener members. First support portion 20 may be constructed of any suitably compressible material, and in the preferred embodiment comprises foam, such as P-80 polyether open cell foam available from the Illbruck Corporation of Minneapolis, Minn. First and second abrasive surfaces 24 and 28 may include abrasive particles bonded to a sheet backing, a woven or nonwoven web material, a profiled surface, or any other known means for abrading a workpiece.

When a first force (indicated schematically as F1 in FIG. 2) is applied to abrading apparatus 18, first abrasive surface 24 contacts workpiece 26. Relative movement between the back-up pad and the workpiece enables the first abrasive surface to abrade material from the workpiece. When the applied force is increased to F2, as shown in FIG. 3, second abrasive surface 28 also contacts the workpiece. Relative movement between the back-up pad and the workpiece enables both the first and the second abrasive surfaces to abrade material from the workpiece. The force may be reduced to F1, which enables the apparatus to abrade the workpiece with only the first abrasive surface again. In this manner, the workpiece may be abraded with at least two abrasive surfaces, which preferably comprise abrasive surfaces adapted to produce different surface finishes (e.g. coarse and fine; buffed and polished).

Two related examples illustrate the utility of the present invention. The first example relates to sanding or grinding a workpiece. First abrasive surface 24 is adapted to remove small amounts of material from a workpiece, and produces a relatively fine surface on the workpiece. Second abrasive surface 28 is adapted to remove large amounts of material from the workpiece, and provides a relatively coarse surface finish. An operator can apply a first force F1 to the apparatus, which will cause first abrasive surface 24 to contact and abrade the workpiece. To remove larger amounts of material from the workpiece, she can apply a second force F2, which is greater than first force F1, to the apparatus. Second force F2 enables first abrasive surface 24 and second abrasive surface 28 to become coplanar, allowing both to contact the workpiece and resulting in greater material removal. To provide a finer surface finish, the operator may reduce the force to F1, which renders the first and second abrasive surfaces non-coplanar. First abrasive surface 24 contacts the workpiece, and smaller amounts of material may be removed from the workpiece to provide the desired finish.

The second example relates to buffing and polishing a workpiece. The first abrasive surface includes a polishing surface, such as polyether open cell foam. Similarly, the second abrasive surface includes a buffing surface, such as nonwoven fibers, natural fibers, or synthetic tufted fibers. As noted previously, polishing and buffing generally require the use of certain compounds to enhance the surface finish, as described in U.S. Pat. No. 5,141,555 (Elepano), which is assigned to the assignee of the present invention. The same compound is typically used for both buffing and polishing. In other respects, the general operation of the first and second abrasive surfaces is the same as that recounted above. That is, the operator applies a first force F1 to contact the workpiece with only the first abrasive surface for polishing. To remove scratches left behind by a previous abrading process, the force may be increased to F2, which enables both the buffing surface and the polishing surface to contact the workpiece. When the surface has been sufficiently buffed, the operator can reduce the force to first force F1, which is less than F2, to contact the workpiece with only the first abrasive surface for polishing. The polishing member removes any streaks left by the buffing member to provide the desired surface finish.

The abrasive article of the present invention may also be described in terms of the thicknesses of the first and second support portions and first and second abrasive surfaces relative to second surface 16, as shown in FIG. 2A. First support portion 20 adjoins second surface 16, and first abrasive surface 24 adjoins first support portion 20. Under second force F2, first support portion 20 and first abrasive surface 24 have a combined thickness "$t_f$." Second support portion 22 adjoins second surface 16, and second abrasive surface 28 adjoins second support portion 22. Second support portion 22 and second abrasive surface 28 have a combined thickness "$t_s$."

When any force less than F2 is applied (e.g. F1) to the abrasive article 10, $t_f$ is greater than $t_s$, and only first abrasive surface 24 contacts and abrades the workpiece. When a force equal to or greater than F2 is applied, first support portion 20 is compressed until $t_f$ is approximately equal to $t_s$, and both first and second abrasive surfaces 24 and 28 contact and abrade the workpiece. It should be appreciated that the magnitude of F1 and F2 are dependent on the materials from which the present abrasive article is constructed, and may vary depending on the application.

The illustrated embodiments of the present invention may be modified to provide an abrasive article wherein the progressive application of greater force results in a progressive increase in the proportion of the abrasive surface(s) that contact the workpiece. For example, a circular back-up pad may include a conically concave support surface and abrasive surface, such that the application of increasing force enables a progressively larger proportion of the abrasive surface to contact the workpiece. Alternatively, a circular back-up pad may include a conically convex support surface and abrasive surface, such that the application of increasing force similarly enables a progressively larger proportion of the abrasive surface to contact the workpiece.

It is believed that certain advantages may result from using the abrasive article of the present invention. The present invention may produce a finer surface finish than sequential abrading, because the abrasive surface adapted for producing a fine surface finish has typically contacted the workpiece for several revolutions during the time the abrasive surface adapted for producing a coarse surface finish is removing material from the workpiece. The former is slightly worn when the operator reduces the force from F2, because the sharper abrasive particles have already been slightly dulled. As a result, the abrasive surface adapted for producing a surface finish is finer than a virgin abrasive surface of the same type would be.

It should be noted that the present invention has particular utility with a first abrasive surface that is adapted to produce a surface finish that is different from the surface finish produced by the second abrasive surface. However, the first and second abrasive surfaces could instead possess substantially identical abrasive properties, if such a configuration is desirable.

Figure 2:
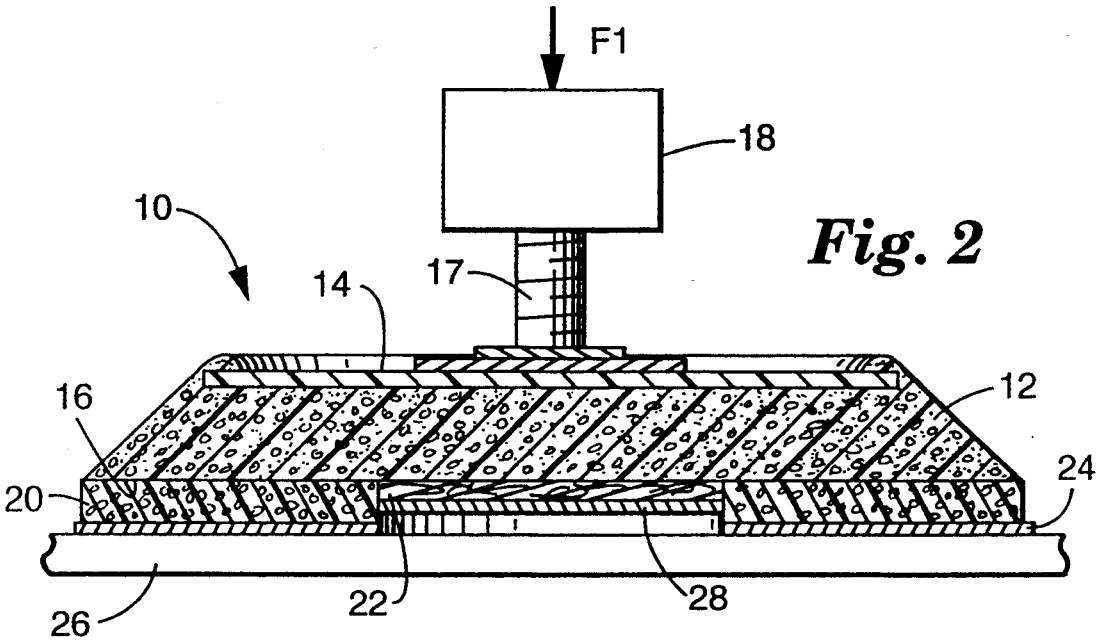
FIG. 2 is a sectional view through 2—2 of FIG. 1, wherein the abrasive article is subject to a first force F1.
Figure 3:
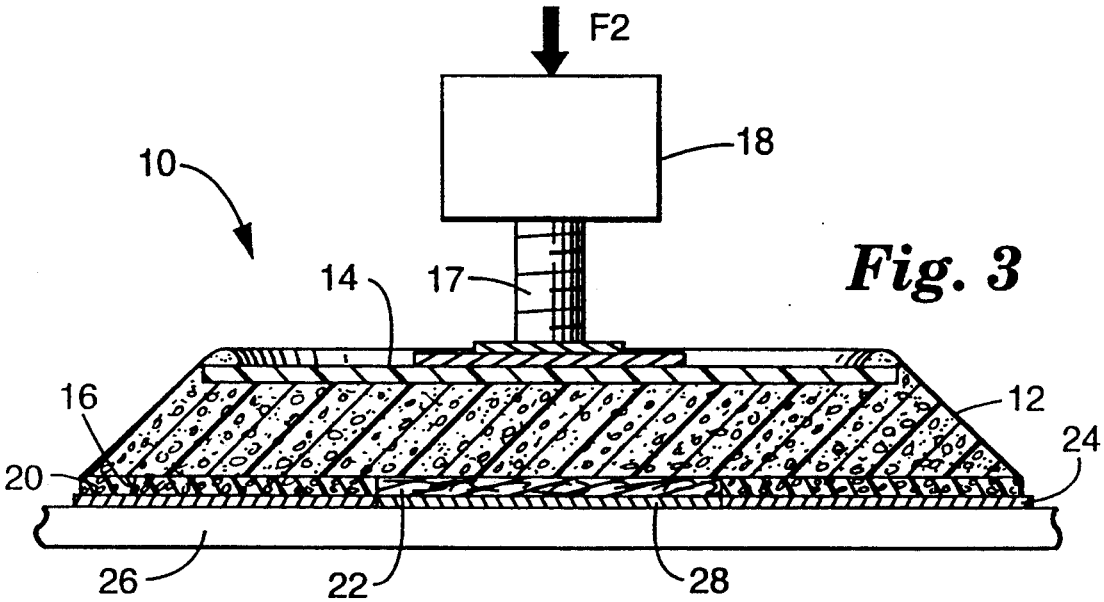
FIG. 3 is a sectional view through the abrasive article of FIG. 1, wherein the abrasive article is subject to a second force F2.
Figure 2A:
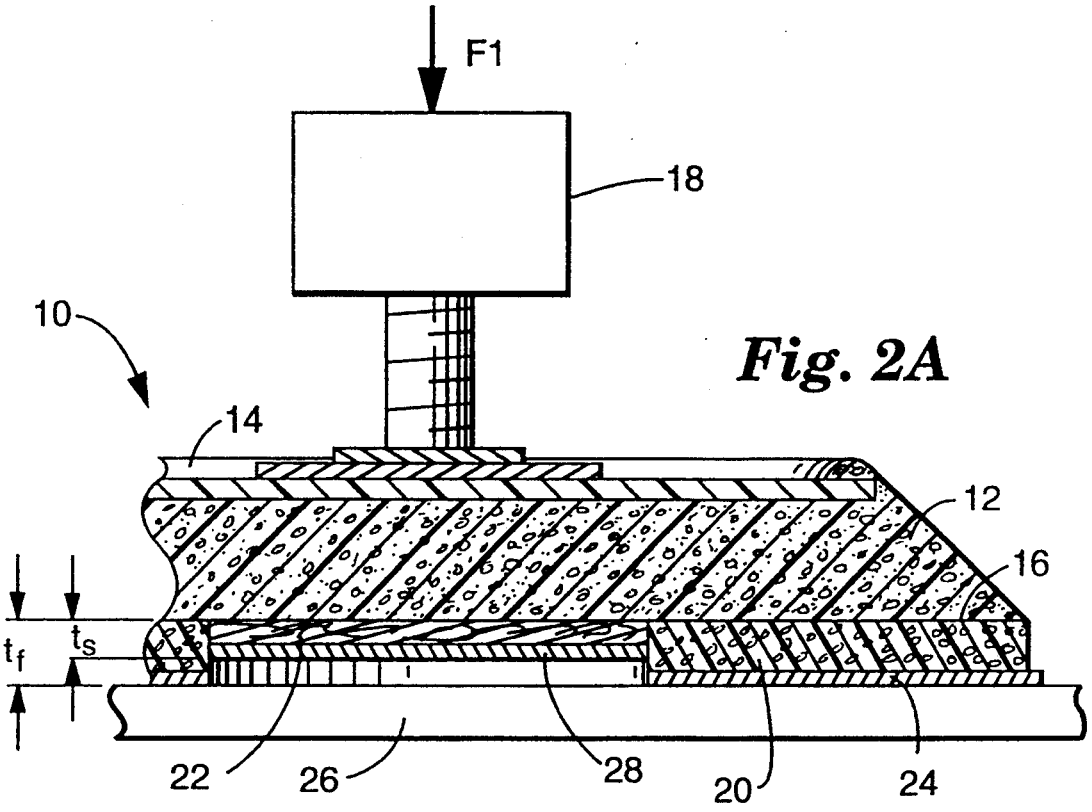
FIG. 2A is an exploded view of the sectional view of FIG. 2.

In the embodiment illustrated in FIGS. 1 through 3, first support surface 20 and first abrasive surface 24 are shown as concentrically surrounding second support surface 22 and second abrasive surface 28, which are circular. In another embodiment, the first abrasive surface could comprise a circular central portion, and the second abrasive surface could comprise an outer concentric ring. Other embodiments are also contemplated, including those described immediately below.

Figure 4:
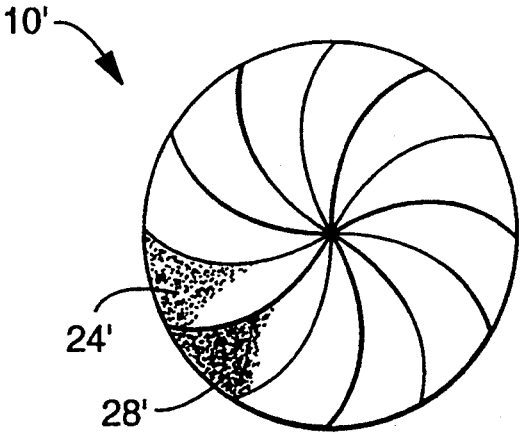
FIG. 4 is a plan view of a second embodiment of the abrasive article of the present invention.

Another embodiment of an abrasive article 10' according to the present invention is shown in FIG. 4. Alternating first abrasive surfaces 24' and second abrasive surfaces 28' extend generally spirally from the center, and otherwise operate in the manner described above. One potential advantage of the embodiment shown in FIG. 4 is the distribution across the face of the abrasive article of both the first and second abrasive surfaces. Because of this distribution, the first abrading area 24' is not limited to the center of the abrasive article, and the second abrading area 28' is not limited to the periphery of the article.

Figure 5:
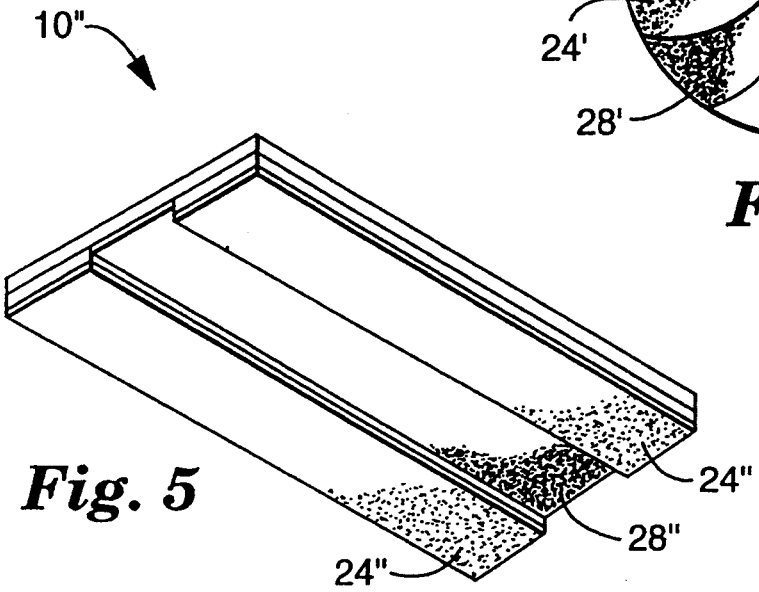
FIG. 5 is a perspective view of another embodiment of the abrasive article of the present invention.

Another embodiment of the abrasive article of the present invention is shown generally in FIG. 5. The abrasive article 10'' is generally rectangular, and may have particular utility when used in conjunction with a dual action sander having an elliptical motion. Alternatively, the abrasive article 10'' may be adapted for use as a manual sanding tool. First abrading area 24'' is located along both longitudinal edges, and second abrading area 28'' is disposed therebetween. As with the embodiments discussed above, the application of a first force enables first abrading area 24'' to contact and abrade a workpiece, and a second force, which is greater than the first force, enables both first abrading area 24'' and second abrading area 28'' to contact and abrade the workpiece. The grade or texture of the abrasive on the respective faces may be selected as appropriate to the application.

The present invention has now been described with reference to several embodiments thereof. It will be apparent to those skilled in the art that many changes can be made in the embodiments described without departing from the scope of the invention. For example, although the examples described above include first and second abrasive surfaces, the present invention also contemplates an abrasive article having more than two abrasive surfaces. Patterns of the first and second abrasive surfaces other than those shown are also intended to be within the scope of the present invention. Thus, the scope of the present invention should not be limited to the structures described herein, but only by structures described by the language of the claims and the equivalents of those structures.

I claim:

1. An abrasive article for abrading material from a workpiece, comprising a back-up pad having at least one abrading surface comprising means for abrading the workpiece, wherein a first generally planar portion of the at least one abrading surface contacts the workpiece in response to a first force applied to the abrasive article, and first and second generally planar portions of the at least one abrading surface contact the workpiece in response to a second force applied to the abrasive article, wherein the second force is greater than the first force, the abrasive means disposed on the first abrading surface is for polishing the surface of the workpiece, and the abrasive means disposed on the second abrading surface is for buffing the surface workpiece.

2. The abrasive article of claim 1, wherein at least one of said first abrasive surface and said second abrasive surfacecomprises open cell foam.

3. The abrasive article of claim 1, wherein the abrasive article includes means for carriage by and movement relative to a powered sanding apparatus.

4. The abrasive article of claim 1, wherein the abrasive article includes means for manual manipulation by an operator.

5. The abrasive article of claim 1, wherein the abrading means each comprises one of bonded abrasives, coated abrasives, and nonwoven abrasives.

6. An abrasive article for abrading material from a workpiece, comprising a back-up pad having a central substantially planar abrading surface comprising means for abrading the workpiece, and at least one peripheral substantially planar abrading surface comprising means for abrading the workpiece, wherein one of the planar abrading surfaces contacts the workpiece in response to a first force applied to the abrasive article in the direction of the workpiece, and all of the planar abrading surfaces contact the workpiece in response to a second force applied to the abrasive article in the direction of the workpiece, wherein the second force is greater than the first force, the central abrasive surface includes abrading means for producing a fine surface finish on the workpiece, and the at least one peripheral abrasive surface includes abrading means for producing a coarse surface finish on the workpiece.

7. The abrasive article of claim 6, wherein the abrasive surfaces each comprise one of a bonded abrasive, a coated abrasive, and a nonwoven abrasive.

8. The abrasive article of claim 6, wherein the abrasive article includes means for carriage by and movement relative to a powered abrading apparatus.

9. The abrasive article of claim 6, wherein the abrasive article includes means for manual manipulation by an operator.

10. An abrasive article for abrading material from a workpiece, comprising a back-up pad having a circular central substantially planar abrading surface comprising means for abrading the workpiece, and a concentric, circular substantially planar abrading surface surrounding said central abrading surface and comprising means for abrading the workpiece, wherein one of the planar abrading surfaces contacts the workpiece in response to a first force applied to the abrasive article in the direction of the workpiece, and both of the planar abrading surfaces contact the workpiece in response to a second force applied to the abrasive article in the direction of the workpiece, wherein the second force is greater than the first force, the central abrasive surface includes abrading means for producing a fine surface finish on the workpiece, and the concentric abrasive surface includes abrading means for producing a coarse surface finish on the workpiece.

11. The abrasive article of claim 10, wherein the abrasive article includes means for carriage by and movement relative to a powered abrading apparatus.

12. The abrasive article of claim 10, wherein the abrasive article includes means for manual manipulation by an operator.

13. The abrasive article of claim 10, wherein the abrasive surfaces each comprise one of a bonded abrasive, a coated abrasive, and a nonwoven abrasive.

14. A method of abrading material from a workpiece, comprising the steps of:

(a) providing an abrading apparatus having:

(i) a body including means for permitting manipulation by an operator, and (ii) a resilient back-up pad attached to the body, the back-up pad including first and second planar abrasive surfaces having means for abrading the workpiece, the surfaces being non-coplanar when no force is applied to the back-up pad;

(b) urging the abrading apparatus against the workpiece using a first force to enable the first abrasive surface to contact and move relative to the workpiece to abrade material therefrom; and (c) urging the abrading apparatus against the workpiece using a second force that is greater than the first force, to enable the first and second abrasive surfaces to contact and move relative to the workpiece to abrade material therefrom.

15. The method of claim 14, wherein the first and second abrasive surfaces each include means for producing a different surface on the workpiece.

16. The method of claim 14, wherein the back-up pad is movably connected with the body, and the body comprises motive means for inducing relative movement between the body and the back-up pad.

17. The method of claim 14, wherein said first abrading surface includes means for polishing the surface of the workpiece, and the second abrading surface includes means for buffing the surface of the workpiece, and wherein the method further comprises (d) applying a compound to the surface of the workpiece to facilitate buffing and polishing.

18. The abrasive article of claim 17, wherein at least one of the first abrasive surface and the second abrasive surface comprises open cell foam.

* * * * *

UNITED STATES PATENT AND TRADEMARK OFFICE

CERTIFICATE OF CORRECTION

PATENT NO. : 5,389,032

DATED : February 14, 1995

INVENTOR(S) : Kris A. Beardsley

It is certified that error appears in the above-indentified patent and that said Letters Patent is hereby corrected as shown below:

On the title page, in the "References Cited" section, the date of U.S. Patent No. 5,297,364 should be 3/1994, not 3/1992.

At the end of the "References Cited" section, insert the following:

-- OTHER DOCUMENTS

3M Brochure entitled "Finesse-it™ System - The single source paint repair system!"; Brochure No. 60-4400-0344-4

3M Brochure entitled "The Perfect-It™ Paint Polishing System"; Brochure No. 60-4400-2620-5(908)ii 3M Brochure entitled "There Are Many Paint Systems For Use On Automobiles . . . 3M Has The 'Perfect' System For Finishing Them"; Brochure No. 60-4400-2619-7 --.

In Claim 1 (column 7, line 3), "buffing the surface workpiece" should be --buffing the surface of the workpiece--.

In Claim 2 (column 7, line 6), "surfacecomprises" should be --surface comprises--.

Signed and Sealed this

Nineteenth Day of November, 1996

*Attest:*

Bruce Lehman

BRUCE LEHMAN

*Attesting Officer*

*Commissioner of Patents and Trademarks*